US011428238B2

(12) United States Patent
Haaf et al.

(10) Patent No.: US 11,428,238 B2
(45) Date of Patent: Aug. 30, 2022

(54) DIAGONAL FAN HAVING AN OPTIMIZED HOUSING

(71) Applicant: ebm-papst Mulfingen GmbH & Co. KG, Mulfingen (DE)

(72) Inventors: Oliver Haaf, Kupferzell (DE); Daniel Gebert, Ohringen (DE)

(73) Assignee: emb-papst Mulfingen GmbH & Co. KG, Mulfingen (DE)

( * ) Notice: Subject to any disclaimer, the term of this patent is extended or adjusted under 35 U.S.C. 154(b) by 0 days.

(21) Appl. No.: 17/274,764

(22) PCT Filed: Nov. 5, 2019

(86) PCT No.: PCT/EP2019/080223
§ 371 (c)(1),
(2) Date: Mar. 9, 2021

(87) PCT Pub. No.: WO2020/099183
PCT Pub. Date: May 22, 2020

(65) Prior Publication Data

US 2022/0049714 A1 Feb. 17, 2022

(30) Foreign Application Priority Data

Nov. 16, 2018 (DE) ..... 102018128820.4

(51) Int. Cl.
*F04D 29/32* (2006.01)
*F04D 19/00* (2006.01)
(Continued)

(52) U.S. Cl.
CPC ..... *F04D 29/325* (2013.01); *F04D 19/002* (2013.01); *F04D 25/06* (2013.01); *F04D 29/4226* (2013.01)

(58) Field of Classification Search
CPC ..... F04D 19/002; F04D 25/06; F04D 29/325; F04D 29/4226
See application file for complete search history.

(56) References Cited

U.S. PATENT DOCUMENTS 10,851,792 B2 * 12/2020 Gebert ..... F04D 29/444
2008/0075585 A1 3/2008 Acre
(Continued)

FOREIGN PATENT DOCUMENTS

CN 209743196 U 12/2019
DE 102014210373 A1 12/2015
(Continued)

OTHER PUBLICATIONS

German Search Report dated Mar. 6, 2020.
International Search Report dated Feb. 4, 2020.
Chinese Office Action dated Jul. 5, 2022.

*Primary Examiner* — Patrick Hamo
(74) *Attorney, Agent, or Firm* — Dickinson Wright PLLC

(57) ABSTRACT

A diagonal fan having an electric motor, a housing and a diagonal impeller generating a diagonal flow which is deflected into an axial flow direction. The diagonal impeller has impeller blades, an air inlet and an air outlet, wherein the housing forms a flow channel for an airflow generated by the diagonal impeller, which has a non-rotationally symmetric axial section and a cylindrical axial section axially directly adjacent, as seen in the flow direction, wherein an air outlet-side radial outer end of the diagonal impeller is arranged in the cylindrical axial section of the flow channel of the housing and an air gap is provided between the radial outer end and the housing, and wherein the non-rotationally symmetric axial section of the flow channel is arranged in a region of the flow channel which is adjacent to the air-inlet side of the air gap in an axial plane with the diagonal impeller.

15 Claims, 3 Drawing Sheets

(51) Int. Cl.
*F04D 25/06* (2006.01)
*F04D 29/42* (2006.01)

(56) References Cited

U.S. PATENT DOCUMENTS

| | | | | |
|---|---|---|---|---|
| 2010/0111667 | A1 | 5/2010 | Stagg | |
| 2012/0020778 | A1* | 1/2012 | Ruck | F04D 29/281 415/208.1 |
| 2012/0039731 | A1* | 2/2012 | Sadi | F04D 29/164 417/423.7 |
| 2015/0098817 | A1 | 4/2015 | Innocenti | |
| 2019/0101122 | A1* | 4/2019 | Gebert | F04D 17/165 |
| 2021/0277910 | A1* | 9/2021 | Heli | F04D 25/0613 |
| 2022/0025892 | A1* | 1/2022 | Haaf | F04D 17/06 |
| 2022/0049715 | A1* | 2/2022 | Haaf | F04D 29/329 |
| 2022/0106966 | A1* | 4/2022 | Heli | F04D 29/325 |

FOREIGN PATENT DOCUMENTS

| | | | |
|---|---|---|---|
| DE | 112016003244 | T5 | 4/2018 |
| DE | 102016122533 | A1 | 5/2018 |
| EP | 2410183 | A2 | 1/2012 |
| EP | 3372838 | A1 | 3/2018 |
| WO | 2014109850 | A1 | 7/2014 |

* cited by examiner

DIAGONAL FAN HAVING AN OPTIMIZED HOUSING

RELATED APPLICATIONS

This application claims priority to and is a 35 U.S.C. § 371 national phase application of PCT/EP2019/080223, filed Nov. 5, 2019 and claims priority to German Patent Application No. 10 2018 128 820.4, filed Nov. 16, 2018, 2018, the entire contents of which are incorporated herein by reference in their entirety.

FIELD

The disclosure relates to a diagonal fan with a housing optimized with respect to the torque of the driving electric motor.

BACKGROUND

Diagonal fans and their use generally are known from the prior art, for example from DE 10 2014 210 373 A1.

Diagonal fans are used in applications with high air output requirements at high counter-pressures and small installation spaces, for example in cooling technology or extractor hoods. Due to the large motor diameter of the motor arranged centrally on the axis in relation to the installation space of diagonal fans, and due to the radial extent of the hub, the outlet area at the outlet opening is relatively small, which leads to high leakage losses in the flow due to high dynamic pressure at the outlet of the diagonal fan.

When installing a diagonal fan in a cylindrical housing, the torque requirement of the fan is reduced compared to a free-wheeling impeller. This behavior is problematic if the impeller is driven by an electric motor, in particular an asynchronous motor, as the motor can only be optimally tuned to one variant.

BRIEF SUMMARY

The disclosure solves the problem of attenuating the torque reduction at the electric motor via a special housing design of the diagonal fan.

This problem is solved by the combination of features according to claim 1.

According to the disclosure, a diagonal fan is proposed with an electric motor, a housing and a diagonal impeller which is received inside the housing and can be driven via the electric motor. The diagonal flow generated by the diagonal impeller in operation is deflected in an axial flow direction by the housing. The diagonal impeller has impeller blades distributed in the circumferential direction as well as an air inlet and an air outlet. The housing forms a flow channel for an airflow generated by the diagonal impeller, which has a non-rotationally symmetric axial section and a cylindrical axial section axially directly adjacent to the former, as seen in the flow direction. An air outlet-side radial outer end of the diagonal impeller is arranged in the cylindrical axial section of the flow channel of the housing. An air gap is provided between the radial outer end and the housing. The non-rotationally symmetric axial section of the flow channel is arranged in a region of the flow channel which is adjacent to the air-inlet side of the air gap in an axial plane with the diagonal impeller, such that the non-rotationally symmetric axial section of the housing surrounds the diagonal impeller at least in sections.

Due to the special housing design with the cylindrical axial section and non-rotationally symmetrical region in the intake region of the diagonal impeller, the torque reduction of the housing can be attenuated. The electric motor has a lower torque requirement and can be better adjusted and tuned to the various installation situations, such that it always operates in the range of best efficiency and no excessive heat generation is present.

In a refinement of the diagonal fan, it is provided that the non-rotationally symmetric axial section is arranged in an axial plane of the air inlet of the diagonal impeller. Thus, it is ensured that the non-rotationally symmetric geometry of the flow channel, i.e., the inner housing wall, is provided at the axial height of the air inlet of the diagonal impeller in any case.

Furthermore, an embodiment is favorable, in which the housing has at least one radial expansion in the non-rotationally symmetric axial section, as compared to the cylindrical axial section of the flow channel, which expansion forms a cavity. The cavity enlarges the flow channel in the region of the air intake of the diagonal impeller and smoothes the flow. The diagonal impeller thus draws in not only the axial main flow, but also a secondary flow of air that is free of swirls or essentially free of swirls from the cavity, which flows radially outward past the diagonal impeller as an axial return flow.

The swirl reduction is further improved in an exemplary embodiment in which at least one fin is arranged in the cavity, which extends from an inner housing wall in the radial direction to the diagonal impeller. In particular, a plurality of such fins are arranged in the cavity, which are formed on the inner wall of the housing and extend across a specified axial length at the axial height of the diagonal impeller. Due to the flow along the fins, the swirl in the flow is reduced to a relatively greater degree.

Furthermore, an embodiment is advantageous in which multiple radial expansions are provided on the diagonal fan, evenly spaced in the circumferential direction. In particular, the radial expansions are designed identical and each is provided with the fins. The swirl reduction is thus performed evenly over the entire circumference.

In a refinement, the diagonal fan is designed such that the diagonal impeller has a slinger ring radially surrounding the outer side of the impeller blades, which defines the radially outer end of the diagonal impeller on the air outlet side.

Furthermore, in a variant of the diagonal fan, an inlet nozzle is arranged on the housing on the intake side, through which nozzle a main flow of the diagonal fan is drawn in. The inlet nozzle extends such that it at least partially overlaps the slinger ring, as seen in the radial section, and thus forms a nozzle gap at the air inlet of the diagonal impeller together with the slinger ring. The positive effect of the disclosure is particularly amplified in this embodiment in that it reduces the swirl of the flow supplied to the nozzle gap. The swirling flow at the air outlet of the diagonal impeller flows back towards the air inlet in the axial direction via the air gap in a cylindrical axial section of the flow channel. Here, the flow channel has the non-rotationally symmetric axial section, such that the swirl is significantly reduced. This effect is enhanced further by the use of the cavity and fins. The flow supplied to the nozzle gap between the diagonal impeller and the inlet nozzle is essentially free of swirls and thus is equivalent to that of a free-wheeling diagonal impeller, such that the torque requirement of the electric motor is reduced.

In one design variant, the inlet nozzle is formed integrally with the housing in order to keep the number of parts as low as possible.

Furthermore, it is advantageous in the diagonal fan with regards to flow that the slinger ring and the inlet nozzle extend parallel at least in portions in the region of the nozzle gap. In particular, it is preferably provided that the slinger ring extends coaxially radially outside the inlet nozzle, such that the nozzle gap is formed radially on the outside of the inlet nozzle.

In a refinement of the diagonal fan, the slinger ring extends in the nozzle portion parallel to a rotational axis of the diagonal impeller extending in the axial direction of the diagonal fan, i.e., the slinger ring and the inlet nozzle in the overlapping section extend parallel to the axially drawn in flow direction.

To generate an outflow in an obliquely radially outer direction and at an angle to the rotational axis of the diagonal impeller, the slinger ring has a cross-sectional area that radially expands outward in the axial flow direction and is directed toward an inner wall of the housing.

In another embodiment of the diagonal fan, an outlet guide vane device with a plurality of guide vanes, which are distributed in the circumferential direction, is arranged adjacently to the diagonal impeller as seen in the axial flow direction, which outlet guide vane device homogenizes an airflow generated by the diagonal impeller.

An advantageous embodiment of the diagonal fan provides that the outlet guide vane device is formed integrally with the housing. The number of parts and assembly steps can thus be reduced. Sealing between the components also is no longer required.

In a refinement, the outlet guide vane device has a protective grating extending over an outlet portion of the diagonal fan.

Favorable is further an embodiment variant of the diagonal fan, in which the outlet guide vane device, the housing and the protective grating are formed integrally.

Furthermore, a refinement of the diagonal fan is advantageous with regards to a compact design, in which the outlet guide vane device has a motor mount for the electric motor in the hub region. The mounting of the electric motor can thus be conducted by means of the outlet guide vane device.

BRIEF DESCRIPTION OF THE DRAWINGS

Other advantageous refinements of the disclosure are characterized in the dependent claims and/or are described in more detail through the drawings in conjunction with the description of the preferred embodiment of the disclosure. In the drawings:

DETAILED DESCRIPTION

Figure 1:
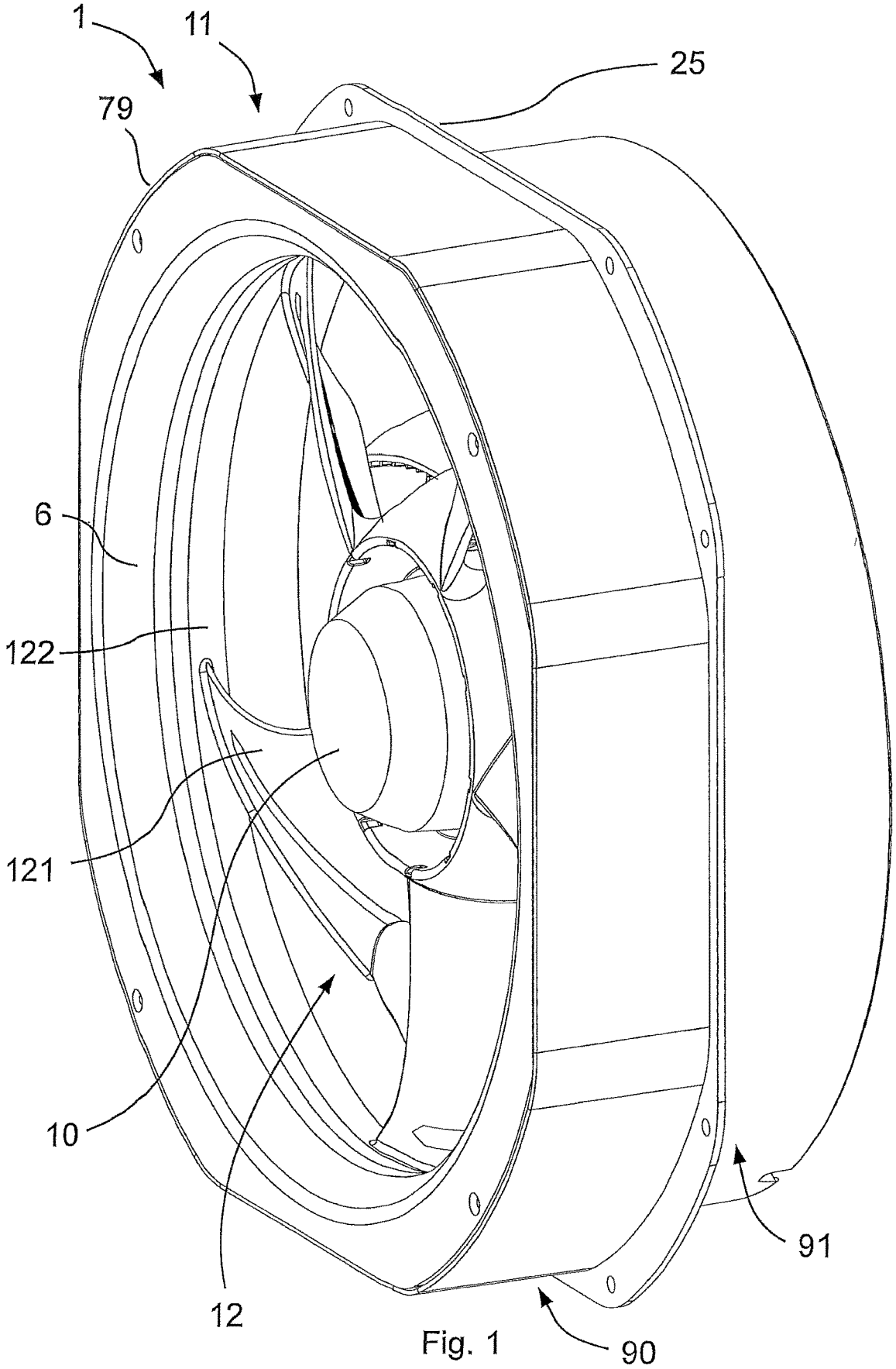
FIG. 1 is a perspective view of an exemplary embodiment of a diagonal fan according to the disclosure.
Figure 2:
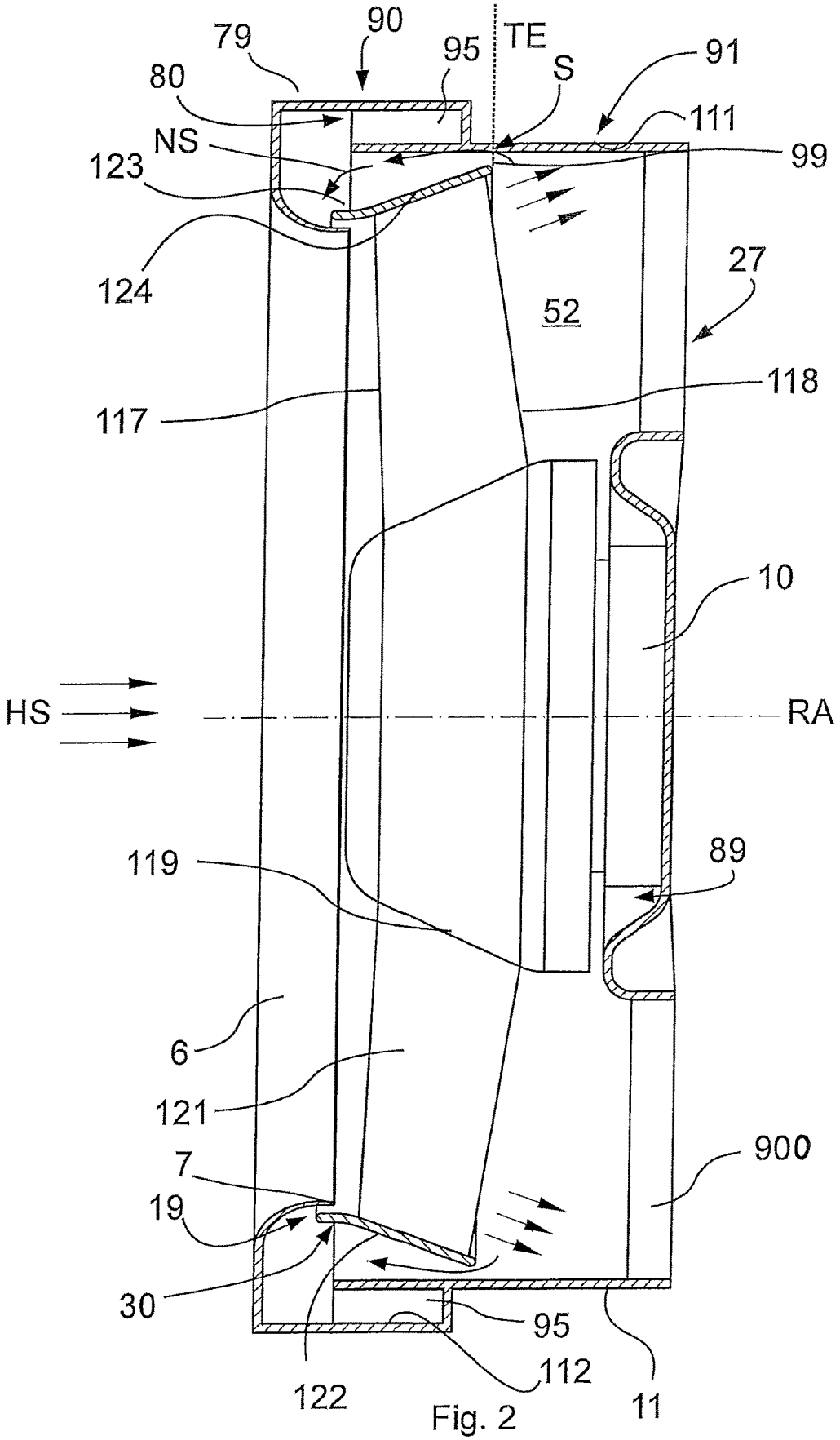
FIG. 2 is a radially sectional view of the diagonal fan from FIG. 1.

The diagonal fan 1 according to FIGS. 1 and 2 comprises a housing 11, in which the electric motor 10 formed as an external rotor motor is received and connected to the diagonal impeller 12 to rotate the latter about the rotational axis RA when in operation. The diagonal impeller 12 is attached to the electric motor 10 with its hub 119. Multiple impeller blades 121, which are distributed in the circumferential direction, extend radial outward from the hub 119, the radially outward end of which impeller blades 121 is closed off by the slinger ring 122. The impeller blades 121 have a blade front edge 117 and a blade rear edge 118, each of which are inclined toward the inlet side of the diagonal fan 1 relative to a vertical line perpendicular to the rotational axis, as seen from radially inside to radially outside, wherein the angle at the blade back edge 118 is greater than at the blade front edge 117.

On the intake side, the inlet nozzle 6 formed integrally on the housing 11 is provided, through which the diagonal impeller 12 draws in the main flow HS during operation. The inlet nozzle 6 has a cross-sectional area tapering in the axial direction, which is smallest at the free axial end section 7. This free end section 7 extends parallel to the rotational axis RA and overlaps with the front section 123 of the slinger ring 122, which also extends parallel to the rotational axis RA, in the overlap region 30. The nozzle gap 19 is formed by the slinger ring 122 and the inlet nozzle 6. In the slinger ring 122, the axis-parallel front section 123 is immediately adjoined by the rear section 124, which extends obliquely outward and at an angle relative to the rotational axis, and which defines the cross-sectional area, which widens radially outward in the axial flow direction and is oriented toward an inner wall 111 of the housing 11.

The housing 11 with its inner wall 111 forms the flow channel 52 for an airflow generated by the diagonal impeller 12, and has the non-rotationally symmetric axial section 90 and a cylindrical axial section 91 axially directly adjacent to the former, as seen in the flow direction. The non-rotationally symmetric axial section 90 comprises multiple cavities 80 distributed evenly across the circumference, which cavities 80 are formed by radial expansions 79 of the housing 11, including in the region of the inlet nozzle 6, relative to the cylindrical axial section 91. In each of the cavities 80, multiple fins 95 are arranged, distributed across the circumference, extending in the axial direction, protruding radially inward from the housing inner wall 112, and extending in an axial plane with the diagonal impeller 12.

The arrangement of the non-rotationally symmetric axial section 90 is positioned in the air inlet-side region upstream relative to the air gap S, which is formed between the radially outer end 99 of the diagonal impeller 12 and the inner housing wall 111 in the cylindrical axial portion 91 of the flow channel 52. Therein, the non-rotationally symmetric axial section 90 extends to the inlet nozzle 6 and surrounds the diagonal impeller 12 in the circumferential direction significantly beyond half of its axial extension. In particular, the non-rotationally symmetric axial section 90 is also provided in the region, i.e., in the axial plane of the nozzle gap 19 between the inlet nozzle 6 and the slinger ring 122, and thus in the region of the air inflow into the diagonal impeller 12. The axially drawn-in main flow HS is deflected back to the axial direction by the housing inner wall 111 after exiting in a diagonally oblique outward-facing direction from the diagonal impeller 12. A portion of the flow, which is swirling upon exit, flows through the air gap S as a secondary flow NS back over the non-rotationally symmetric axial section 90 with the radial expansions 79, the cavities 80 and fins 95, where the swirl of the secondary flow NS is reduced before it re-enters the diagonal impeller 12 via the nozzle gap 19.

Figure 3:
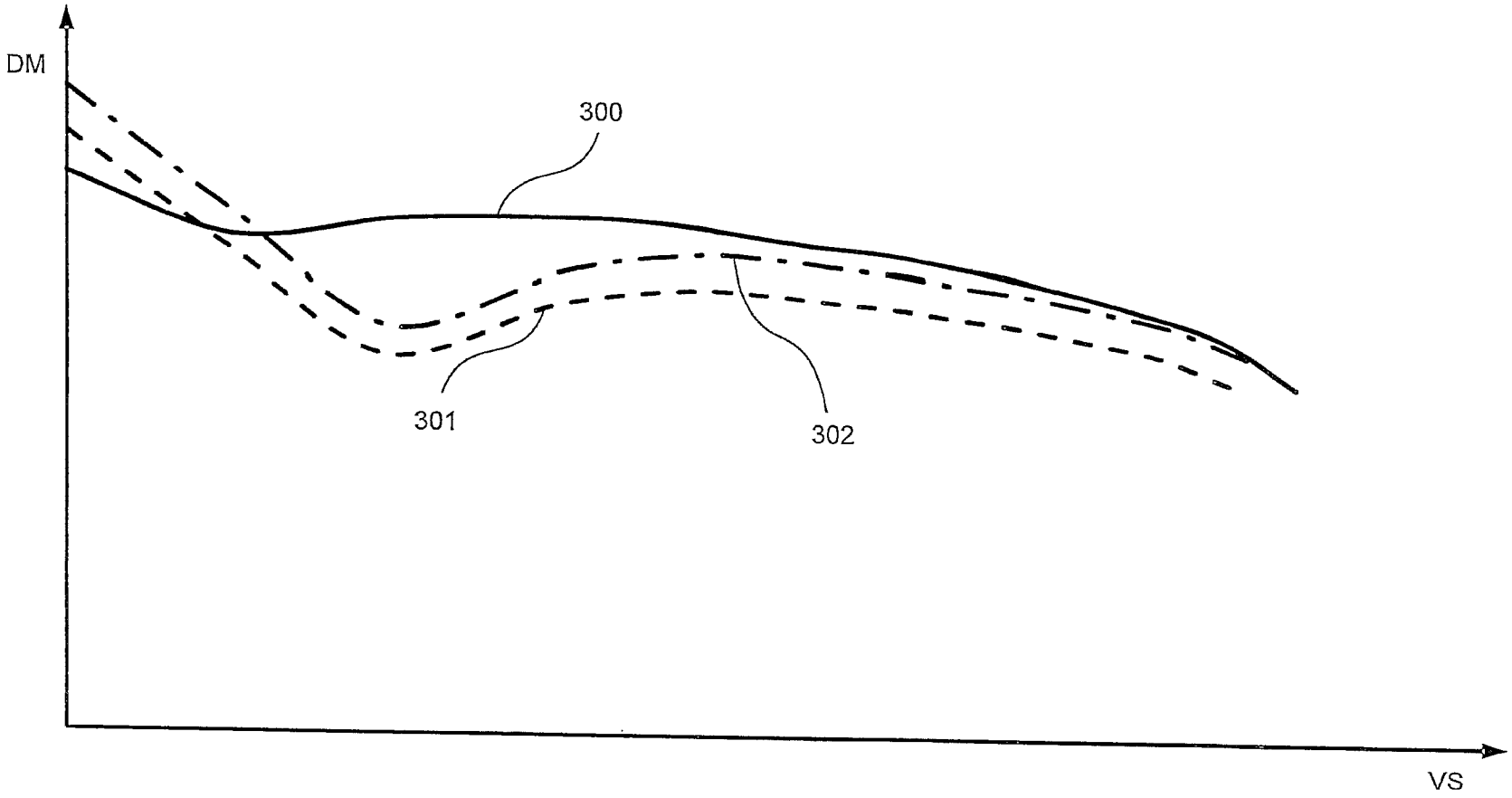
FIG. 3 is a diagram for comparing torque curves.

The advantageous technical effect is shown in the diagram of FIG. 3, where characteristic curves of the torque curve DM of the electric motor 10 compared to the mass flow VS for a free-wheeling diagonal fan (characteristic curve 300), a diagonal fan with an exclusively cylindrical housing (characteristic curve 301—prior art) and the diagonal fan 1 with the housing according to the embodiment according to FIG. 2 (characteristic curve 302) are shown. In particular at higher mass flows, the curve of the diagonal fan 1 according to the disclosure essentially corresponds to that of a free-wheeling diagonal fan.

Referring to FIG. 2, the diagonal fan 1 also comprises an outlet guide vane device 900 at the outlet portion 27, which device subsequently homogenizes the diagonal flow blown out at an angle by the diagonal impeller 12 and the flow deflected back in the axial direction by the inner wall 11. The outlet guide vane device 900 optionally comprises a plurality of guide vanes distributed in the circumferential direction and a protective grating (not shown), which then extends beyond the outlet portion 27 of the diagonal fan 1. In addition, the outlet guide vane device 900 in the region of its central axis defines the motor mount 89 for the electric motor 10.

The invention claimed is:

1. A diagonal fan comprising an electric motor, a housing and a diagonal impeller received within the housing and operable via the electric motor, the diagonal flow generated during the operation of which diagonal impeller is deflected into an axial flow direction, wherein the diagonal impeller has impeller blades distributed in the circumferential direction as well as an air inlet and an air outlet, wherein the housing forms a flow channel for an airflow generated by the diagonal impeller, the flow channel having a non-rotationally symmetric axial section and a cylindrical axial section axially directly adjacent to the non-rotationally symmetric axial section, as seen in the flow direction, wherein a radial outer end of the diagonal impeller at an air outlet-side is arranged in the cylindrical axial section of the flow channel of the housing and an air gap (S) is provided between the radial outer end and the housing, and wherein the non-rotationally symmetric axial section of the flow channel is arranged in a region of the flow channel which is adjacent to an air-inlet side of the air gap (S) in an axial plane with the diagonal impeller, such that the non-rotationally symmetric axial section surrounds the diagonal impeller at least in sections.

2. The diagonal fan according to claim 1, wherein the non-rotationally symmetric axial section is arranged in an axial plane of the air inlet of the diagonal impeller.

3. The diagonal fan according to claim 1, wherein the housing has at least one radial expansion in the non-rotationally symmetric axial section, as compared to the cylindrical axial section of the flow channel, the at least one radial expansion forming a cavity.

4. The diagonal fan according to claim 3, wherein at least one fin is arranged in the cavity, which fin extends from an inner housing wall in the radial direction to the diagonal impeller.

5. The diagonal fan according to claim 4, wherein the at least one fin extends between the air inlet and the air outlet of the diagonal impeller, as seen in the axial direction.

6. The diagonal fan according to claim 3, wherein multiple radial expansions are provided in the circumferential direction in an even distribution.

7. The diagonal fan according to claim 1, wherein the diagonal impeller has a slinger ring radially surrounding the outer side of the impeller blades, which defines the radially outer end of the diagonal impeller on the air outlet side.

8. The diagonal fan according to claim 7, wherein an inlet nozzle is arranged on the intake side of the housing, through which inlet nozzle a main flow (HS) of the diagonal fan is drawn in, wherein the inlet nozzle extends such that it at least partially overlaps the slinger ring as seen in a radial sectional view, and thus forms a nozzle gap with the slinger ring.

9. The diagonal fan according to claim 8, wherein the inlet nozzle is formed integrally with the housing.

10. The diagonal fan according to claim 8, wherein the slinger ring and the inlet nozzle extend parallel to each other at least in sections in the region of the nozzle gap.

11. The diagonal fan according to claim 8, wherein the slinger ring extends coaxially radially outside the inlet nozzle.

12. The diagonal fan according to claim 7, wherein the slinger ring in the region of the nozzle gap extends parallel to a rotational axis of the diagonal impeller extending in the axial direction of the diagonal fan.

13. The diagonal fan according to claim 7, wherein the slinger ring has a cross-sectional area which expands radially outward in the axial flow direction and which is orientated toward the inner wall of the housing.

14. The diagonal fan according claim 1, wherein an outlet guide vane device with a plurality of guide vanes, which are distributed in the circumferential direction, is arranged adjacent to the diagonal impeller as seen in the axial flow direction, which outlet guide vane device homogenizes an airflow generated by the diagonal impeller.

15. The diagonal fan according to claim 14, characterized in that the outlet guide vane device has a motor mount for the electric motor in the region of its central axis.

* * * * *